US006174200B1

(12) United States Patent
Bigotto et al.

(10) Patent No.: US 6,174,200 B1
(45) Date of Patent: Jan. 16, 2001

(54) ELECTRIC CONNECTOR

(75) Inventors: Pier Carlo Bigotto, Cascine Vico Rivoli; Renzo Rampone, Moncalieri, both of (IT)

(73) Assignee: Framatome Connectors International, Courbevoie (FR)

( * ) Notice: Under 35 U.S.C. 154(b), the term of this patent shall be extended for 0 days.

(21) Appl. No.: 09/438,230

(22) Filed: Nov. 12, 1999

(30) Foreign Application Priority Data

Nov. 13, 1998 (IT) ..... T098 A 0960

(51) Int. Cl.[7] ..... H01R 13/40
(52) U.S. Cl. ..... 439/587; 439/589
(58) Field of Search ..... 439/587, 589, 439/752

(56) References Cited

U.S. PATENT DOCUMENTS 5,538,441 7/1996 Paolucci et al. ..... 439/589
5,632,653 * 5/1997 Sawada ..... 439/587

FOREIGN PATENT DOCUMENTS 0 523 857 A2 1/1993 (EP) .
2 078 895 11/1971 (FR) .
2 602 374 2/1988 (FR) .

* cited by examiner

*Primary Examiner*—T. C. Patel
(74) *Attorney, Agent, or Firm*—Perman & Green, LLP

(57) ABSTRACT

An electric connector (1) having an insulating casing (2) defining a number of cavities (3) for respective electric terminals (4); and a sealing unit (20) for protection against external agents and in turn having a sealing member (21) connected to the casing (2), on the side on which the terminals (4) are inserted inside the cavities (3), and having a number of through seats (22) coaxial with the cavities (3) and engaged by respective electric cables (5) connected to the terminals (4); the sealing unit having a protection member (30) in sheet form, which is located on one side of the sealing member (21) and has a number of slitted openings (31) coaxial with the cavities (3) and with the seats (22), and each defined by a number of flexible flaps (32) which are interposed between the respective terminal (4) and the sealing member (21) during passage of the terminal (4) inside the respective seat (22), so as to protect the sealing member (21) from contact with the terminal (4).

8 Claims, 2 Drawing Sheets

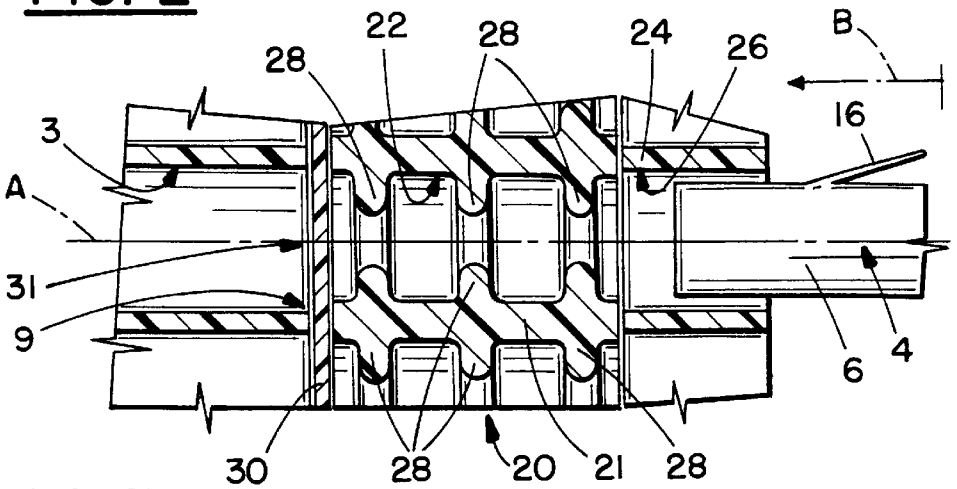
FIG. 2
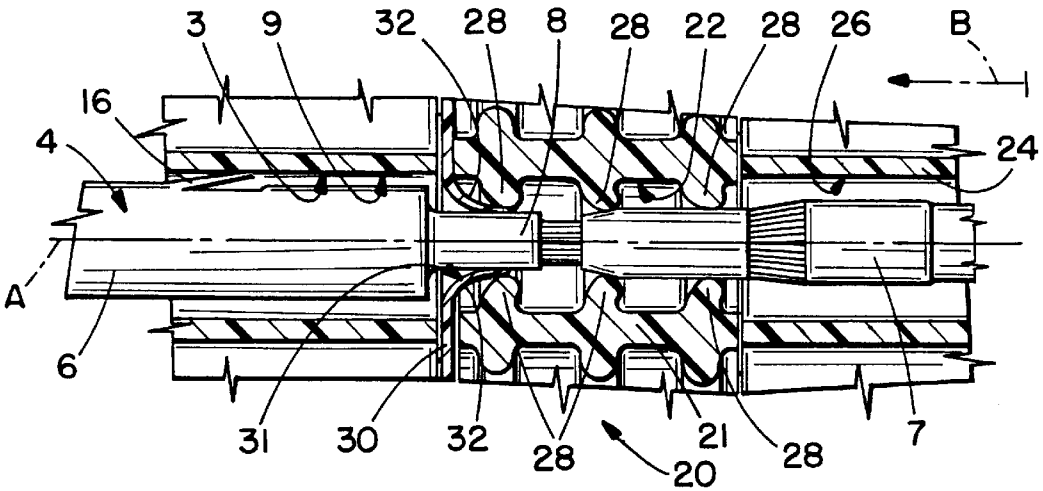
FIG. 3.
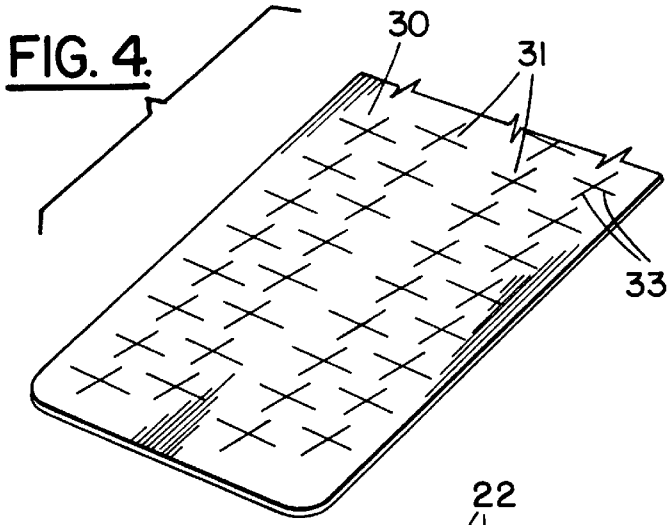
FIG. 4.
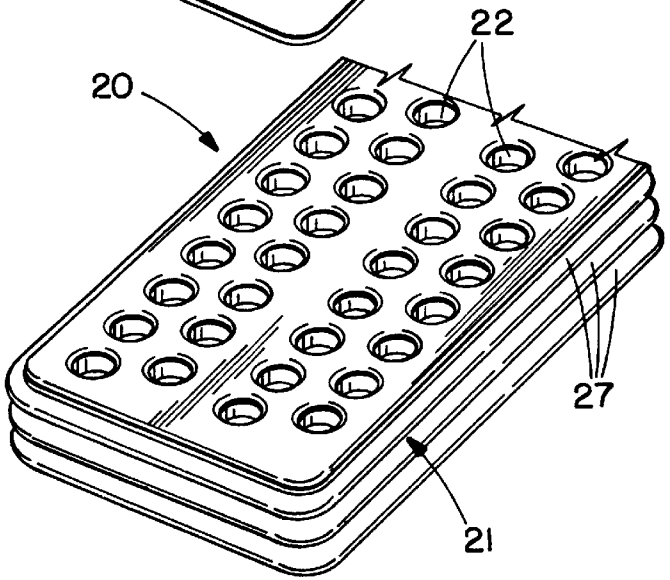

ELECTRIC CONNECTOR

BACKGROUND OF THE INVENTION

The present invention relates to an electric connector, in particular a sealed electric connector.

Electric connectors of the above type are known—for example, from Italian Patent IT 1270371 filed by the present Applicant, and from French Patent FR 2602374—which comprise an insulating casing defining a number of cavities for housing respective electric terminals connected to respective electric cables; and a sealing member for protection against external agents, and which is normally defined by a mattress made of elastomeric material, connected to the casing on the terminal insertion side into the respective cavities, and having a number of through seats coaxial with the cavities and engaged by the respective electric cables.

As is known, when wiring the connector, the electric terminals, already crimped to the respective electric cables, may be inserted into and withdrawn from the respective cavities several times, e.g. to correct assembly errors; in which case, and particularly when withdrawing the terminals from the respective cavities, any sharp edges or aggressive portions of the terminals, such as the elastic lances engaging the walls of the cavities, may possibly damage the sealing member when fitted through the respective seats in the member, thus resulting in cutting or tearing of the seat edges and so impairing in-service sealing of the connector.

It is an object of the present invention to provide an electric connector designed to eliminate, in a straightforward, reliable manner, the aforementioned drawback typically associated with known connectors.

According to the present invention, there is provided an electric connector comprising an insulating casing defining a number of cavities for respective electric terminals; and a sealing unit in turn comprising a sealing member connected to said casing, on the side on which said terminals are inserted inside said cavities, and having a number of through seats coaxial with the cavities and engaged by respective electric cables connected to said terminals; characterized in that said sealing unit comprises at least one protection member in sheet form, which is located on one side of said sealing member and has a number of slitted openings coaxial with said cavities and with said seats, and each defined by a number of flexible flaps which are interposed between the respective said terminal and said sealing member during passage of the terminal inside the respective said seat, so as to protect said sealing member from contact with said terminal.

BRIEF DESCRIPTION OF THE DRAWINGS

A preferred, non-limiting embodiment of the present invention will be described by way of example with reference to the accompanying drawings, in which:

FIG. 2 shows a larger-scale view of an electric terminal being assembled inside a respective cavity of the FIG. 1 connector;

FIG. 3 shows a larger-scale view of the FIG. 2 electric terminal being withdrawn from the respective cavity;

FIG. 4 shows a larger-scale, exploded view in perspective of a sealing unit of the FIG. 1 connector for protection against external agents.

DETAILED DESCRIPTION OF THE INVENTION

Figure 1:
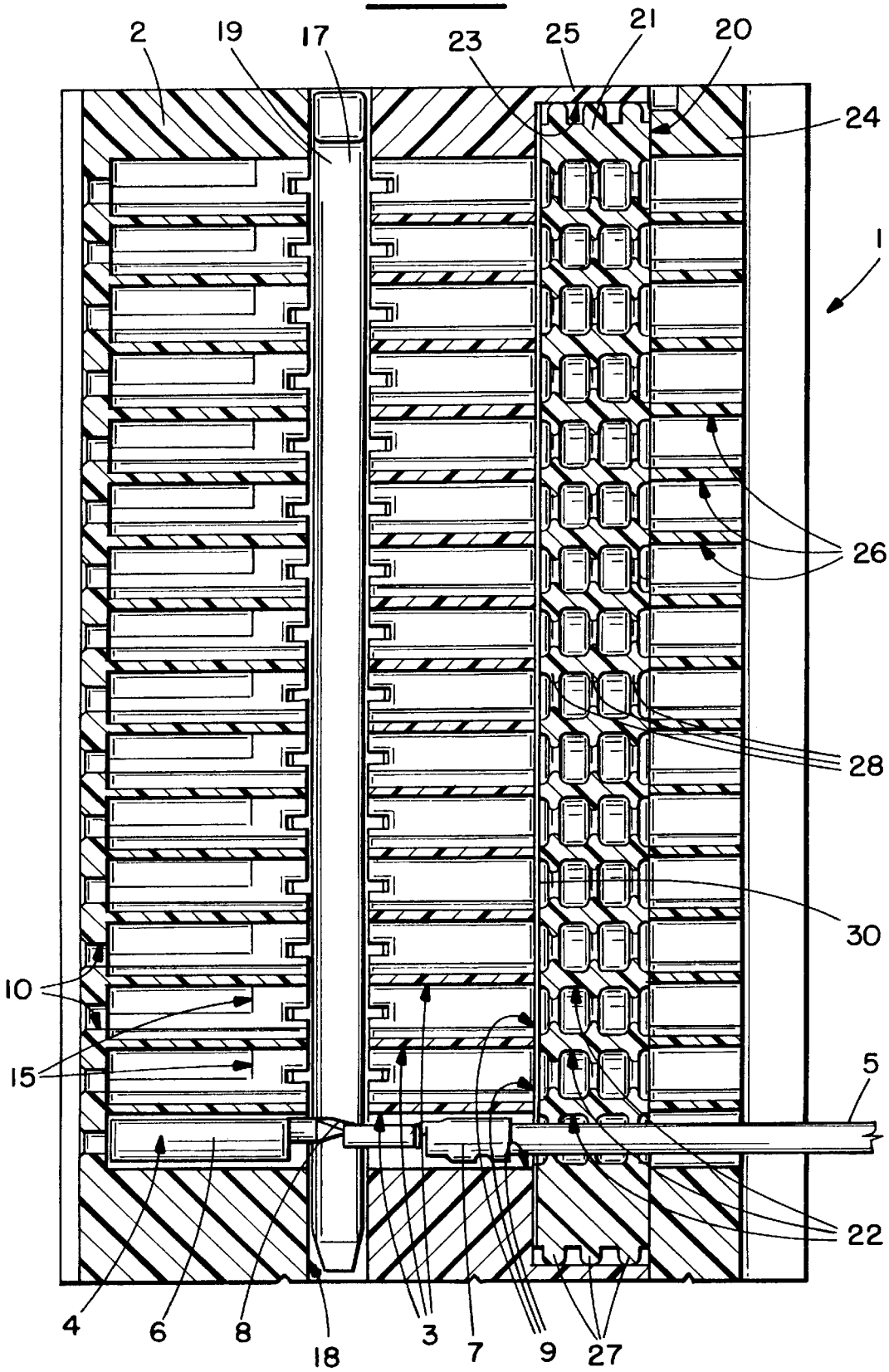
FIG. 1 shows a section of an electric connector in accordance with the present invention.

Number 1 in FIG. 1 indicates a sealed electric connector in accordance with the present invention.

Connector 1 comprises an insulating casing 2 made of plastic material and defining a number of rows of longitudinal cavities 3 having respective axes A parallel to a connection direction B of connector 1 to a complementary connector (FIGS. 2 and 3). Cavities 3 are designed to receive respective female electric terminals 4 (only one shown in FIG. 1) connected to respective electric cables 5 (only one shown in FIG. 1) and retained inside cavities 3 by known primary and secondary retaining means not forming part of the present invention and therefore not described in detail.

With reference to FIGS. 1 to 3, each terminal 4 comprises a substantially cylindrical tubular front contact portion 6 which mates with a corresponding male electric terminal (not shown) of the complementary connector; a rear portion 7 for connection to respective electric cable 5; and an intermediate portion 8 interposed between, and smaller in section than, portions 6 and 7.

Each terminal 4 is inserted inside respective cavity 3 through a rear opening 9 of the cavity, from which respective electric cable 5 projects in use, and is positioned with contact portion 6 facing a front opening 11 of cavity 3.

For each terminal 4, the primary retaining means comprise a retaining seat 15 formed in the lateral wall of respective cavity 3; and an elastic lance 16 projecting outwards from contact portion 6 of terminal 4, substantially in a direction parallel to direction B and towards intermediate portion 8, and which clicks onto seat 15.

The secondary retaining means comprise a substantially comb-shaped movable member 17 formed separately from casing 2 and which fits onto casing 2 in a direction perpendicular to direction B, and inside a seat 18 intersecting cavities 3.

More specifically, movable member 17 comprises a number of arms 19, which cooperate, in pairs and on opposite sides of each row of cavities 3, with intermediate portions 8 of respective terminals 4, to determine correct insertion of terminals 4 inside cavities 3 and prevent withdrawal of the terminals.

In the event any one of terminals 4 is not inserted properly inside respective cavity 3, movable member 17 is prevented from being inserted fully inside seat 18 by respective arms 19 interacting with and so being obstructed by contact portion 6 of terminal 4, which contact portion, as stated, has a larger section than intermediate portion 8.

Connector 1 also comprises a sealing unit for protection against external agents and indicated as a whole by 20 in FIG. 4.

Unit 20 comprises a sealing member 21 defined, in the example shown, by a substantially parallelepipedal mattress made of elastomeric material, fitted to casing 2 on the insertion side of terminals 4 inside cavities 3, and having a number of through seats 22 coaxial with cavities 3 and engaged by respective electric cables 5.

More specifically, sealing member 21 is fitted inside a rear compartment 23 of casing 2 communicating with cavities 3 through openings 9, and is pressed towards cavities 3 by a grille 24, which clicks onto a lateral wall 25 of compartment 23 and has a number of through holes 26 coaxial with cavities 3 and with seats 22 and which are engaged by respective electric cables 5.

Sealing member 21 also has a lateral edge defined by a number of—in the example shown, three—superimposed projecting peripheral lips 27, which cooperate with lateral wall 25 of compartment 23.

Each seat 22 of sealing member 21 has, internally, a number of projecting annular lips 28—three in the example shown—which cooperate in sealing manner with respective electric cable 5.

According to the present invention, unit 20 also comprises a protection member 30 in sheet form, which is located on one side of sealing member 21 and has a number of slitted openings 31 coaxial with cavities 3 and with seats 22, and each defined by a number of flexible flaps 32 which are interposed between the respective terminal 4 and sealing member 21 during passage of the terminal 4 inside respective seat 22, so as to protect sealing member 21 from contact with terminal 4 (FIG. 3).

More specifically, protection member 30 is made of polymer material—in the example shown, mylar—and is interposed between sealing member 21 and openings 9 of cavities 3.

Finally, openings 31 of protection member 30 are each defined by two straight slits 33 intersecting crosswise.

As shown in FIG. 3, when extracting a terminal 4 from respective cavity 3, flaps 32 of respective slitted opening 31 are flexed, by the axial movement of respective cable 5, towards grille 24 and between terminal 4 and lips 28 of respective seat 22 of sealing member 21, so that any sharp edges or aggressive portions of terminal 4, such as elastic lance 16, slide against flaps 32 of protection member 30 without coming into contact with, and hence damaging, lips 28 of sealing member 21.

Clearly, changes may be made to connector 1 without, however, departing from the scope of the present invention.

In particular, depending on the geometry of terminals 4, i.e. on the location of the sharp edges or aggressive contact portions on terminals 4, protection member 30 may be located on the opposite side of sealing member 21 to cavities 3, or two protection members may be provided on either side of sealing member 21.

What is claimed is:

1. An electric connector (1) comprising an insulating casing (2) defining a number of cavities (3) for respective electric terminals (4); and a sealing unit (20) in turn comprising a sealing member (21) connected to said casing (2), on the side on which said terminals (4) are inserted inside said cavities (3), and having a number of through seats (22) coaxial with the cavities (3) and engaged by respective electric cables (5) connected to said terminals (4); wherein said sealing unit (20) comprises at least one protection member (30) in sheet form, which is located on one side of said sealing member (21) and has a number of slitted openings (31) coaxial with said cavities (3) and with said seats (22), and each defined by a number of flexible flaps (32) which are interposed between the respective said terminal (4) and said sealing member (21) during passage of the terminal (4) inside the respective said seat (22), so as to protect a portion of said sealing member (21) from contact with said terminal (4).

2. A connector as claimed in claim 1, wherein each said slitted opening (31) of said protection member (30) is defined by a number of intersecting slits (33).

3. A connector as claimed in claim 2, wherein each said slitted opening (31) of said protection member (30) is defined by two straight said slits (33) intersecting each other crosswise.

4. A connector as claimed in claim 1, wherein said protection member (30) is interposed between said sealing member (21) and said cavities (3).

5. A connector as claimed in claim 1, wherein said protection member (30) is made of polymer material.

6. A connector as claimed in claim 1, wherein said protection member (30) is made of mylar.

7. A connector as claimed in claim 1, wherein each said seat (22) of said sealing member (21) comprises, internally, a number of projecting annular lips (28) cooperating in sealing manner with the respective said electric cable (5).

8. A connector as claimed in claim 1, wherein said sealing member (21) is defined by a mattress of elastomeric material, which is fitted inside a rear compartment (23) of said casing (2) communicating with said cavities (3), and is pressed towards the cavities (3) by a grille (24) fitted to said casing (2) and having a number of through holes (26) coaxial with said cavities (3) and with said seats (22) and which are engaged by respective said electric cables (5).

* * * * *